US005634218A

United States Patent [19]

Ouelette

[11] Patent Number: 5,634,218

[45] Date of Patent: Jun. 3, 1997

[54] ADJUSTABLE LIFTING APPARATUS FOR A SPA

[76] Inventor: Roger J. Ouelette, 5235 S. Kyrene, Suite 24, Tempe, Ariz. 85283

[21] Appl. No.: 445,411

[22] Filed: May 19, 1995

Related U.S. Application Data

[63] Continuation-in-part of Ser. No. 421,437, Apr. 12, 1995.

[51] Int. Cl.[6] ..... E04H 4/06

[52] U.S. Cl. ..... 4/498; 49/263; 49/381

[58] Field of Search ..... 4/498, 580; 49/263, 49/324, 380, 381, 463

[56] References Cited

U.S. PATENT DOCUMENTS

| | | | |
|---|---|---|---|
| 4,168,549 | 9/1979 | Davies | 4/578.1 |
| 4,853,985 | 8/1989 | Perry | 4/498 |
| 5,048,153 | 9/1991 | Wall et al. | 4/498 X |
| 5,131,102 | 7/1992 | Salley et al. | 4/498 |

*Primary Examiner*—Robert M. Fetsuga
*Attorney, Agent, or Firm*—Harris Beach & Wilcox, LLP

[57] ABSTRACT

A lifting frame for a hinged spa cover having a pair of adjustable lifting arms pivotally mounted on or adjacent to a side wall of a spa. The upper part of the arms are equipped with one or more supports that are adjacent to and parallel with the cover hinge whereby the cover is foldable over the support or supports when the lifting arms are in a first horizontal position. Rotating the frame causes the folded cover to be rotated to a second, vertical position adjacent one end wall of the spa. The lifting frame includes a plurality of L-shaped arm segments which are connected in telescoping relationship with one another to form a plurality of overlapped junctions. A plurality of fasteners located in the regions of the junctions, allow the dimensions of the frame to be adjusted to accommodate spas of different sizes.

6 Claims, 13 Drawing Sheets

48
50
52
55
37
35
51
49
38
30
33
44
42
31
29
32
36
26
25
Φ

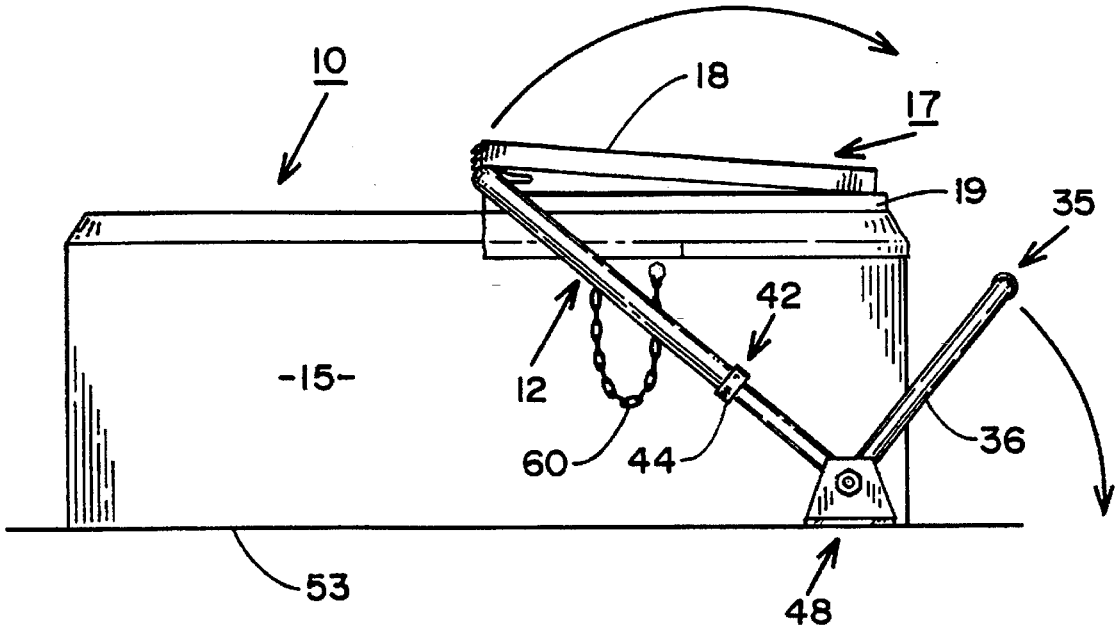
FIG. 11
FIG. 12
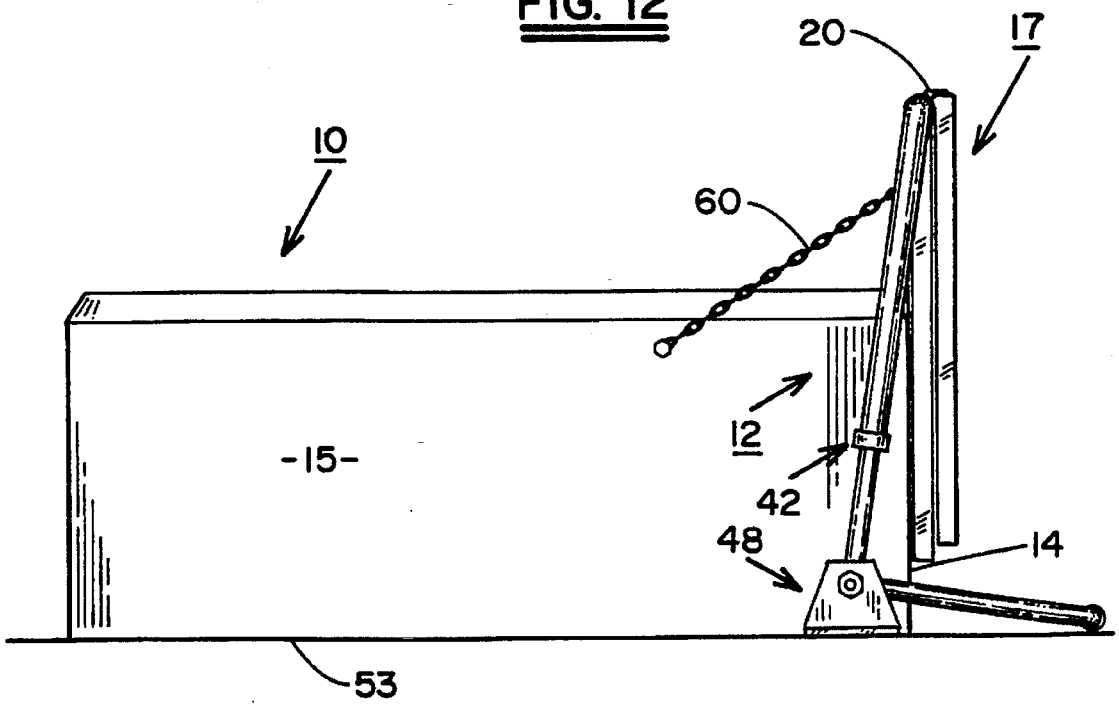

ADJUSTABLE LIFTING APPARATUS FOR A SPA

CROSS REFERENCES TO RELATED APPLICATIONS

This is a continuation-in-part of U.S. patent application Ser. No. 08/421,437, filed Apr. 12, 1995.

BACKGROUND OF THE INVENTION

This invention relates to a lifting mechanism for removing and replacing the cover of a spa.

The use of outdoor spas has become widespread, particularly in the regions of the country that enjoy generally warm weather. Most outdoor spas are equipped with covers which when closed, prevents debris, rain and the like from contaminating the tub water when the spa is not being utilized. The cover further serves to retain heat within the tub to help maintain the water at a desired temperature level. As a consequence, spa covers tend to be relatively heavy and thus difficult to remove and replace.

Lifting devices have been developed to aid in the removal and replacement of these relatively heavy spa covers which can be operated with varying amounts of difficulty by one person. One such lifting device is disclosed in U.S. Pat. No. 5,131,102 to Salley et al. A pair of lifting arms is pivotally mounted along the back wall of a spa and the extended ends of the arms are, in turn, conjoined by a bridge arm that passes over the cover along the center hinge of the cover. To remove the cover, the two half sections of the cover are folded over the bridge arm and the lifting arm is then rotated upwardly and rearwardly to bring the cover to a raised position adjacent to the rear wall of the spa. Although this lifting mechanism works well in practice, the bridge arm tends to become angularly offset when the operator pulls on one or the other of the lifting arms. This in turn can produce excessive wear on the cover and misalignment of the cover. In addition, this lifting arm arrangement provides only a limited amount of mechanical advantage to the operator.

Walls et al., U.S. Pat. No. 5,048,153, describes a similar lifting mechanism for a spa cover in which the extended ends of the lifting arms are securely attached to the opposed side walls of the spa cover using a hinge plate and pivot mechanism. The lifting arms are equipped with spring loaded struts which absorb the weight of the cover as it is rotated into an open position. Again, this type of lifting mechanism has a limited mechanical advantage and the hinge plate connections produce excessive wear on the cover. Lastly, this type of lifting mechanism does not have the adjustability such that it can be adapted for use in association with various sized spas.

SUMMARY OF THE INVENTION

It is therefore an object of the present invention to provide an improved apparatus for removing and replacing relatively heavy spa covers.

A further object of the present invention is to provide a relatively light weight lifting device for a spa cover that is fully adjustable to fit various size spas.

A still further object of the present invention is to provide a lifting apparatus for a spa cover that is simple in construction and provides sufficient mechanical advantage so that it can be easily operated by one person to remove and replace a relatively heavy spa cover.

Another object of the present invention is to provide a lifting apparatus for a spa cover that has an easily accessible foot actuated lever that enables one person to operate the device.

These and other objects of the present invention are attained by a lifting frame for a spa cover that has two half sections conjoined by a hinge whereby the half sections are foldable one over the other, the lifting apparatus having a pair of pivots mounted in the rear wall of the spa, in opposed side walls of a spa, or in the deck adjacent to the side walls or the rear wall. A lifting arm is rotatably mounted in each pivot. In one form of this invention, either a continuous shaft or two stub shafts are is mounted in the upper parts of the lifting arms and is rotatable from a first position adjacent to and parallel with the cover hinge to a second position clear of one end wall of the spa. In operation, the cover is folded over these shafts when the lifting arms are in a first position and then moved with the arms into the second position whereby the cover is supported in a vertical position adjacent to the one end wall. A U-shaped foot actuated lever is secured to the lifting arms with the base of the lever extending across the end wall of the spa. The base of the lever is in an elevated position when the lifting arms are in the first position so that a person attempting to rotate the arms can stand on the base to assist in the rotation of said arms. The elongated base also serves as a rest when the arms are in the second position. The length of each lifting arm is adjustable as is the width of the base whereby the frame can be adjusted to fit various size spas.

In a second, lighter and simpler form of the lifting apparatus of the invention, preferably usable with two stud shafts mounted in the upper parts of the lifting arms, the U-shaped foot actuated lever is eliminated. In addition, the lifting apparatus is provided with upper and lower pairs of L-shaped arms which are arranged to fit together in telescoping relationships to form a plurality of overlapped adjustable joints. In the preferred embodiment of this form of the invention, the adjustable joints include sets of aligned holes which may be selected as necessary to accommodate spas having differing heights and/or widths. This embodiment of the invention has the advantage that it allows the use of fasteners which penetrate and bridge the adjustable joints, thereby greatly increasing the structural integrity of the lifting arms.

BRIEF DESCRIPTION OF THE DRAWINGS

For a better understanding of these and other objects of the present invention, reference will be made to the following detailed description of the invention which is to be read in association with the accompanying drawings, wherein:

FIGS. 11 and 12 are side views of a spa showing the lifting frame in a first lowered position and a second raised position, respectively;

DESCRIPTION OF THE INVENTION

Figure 1:
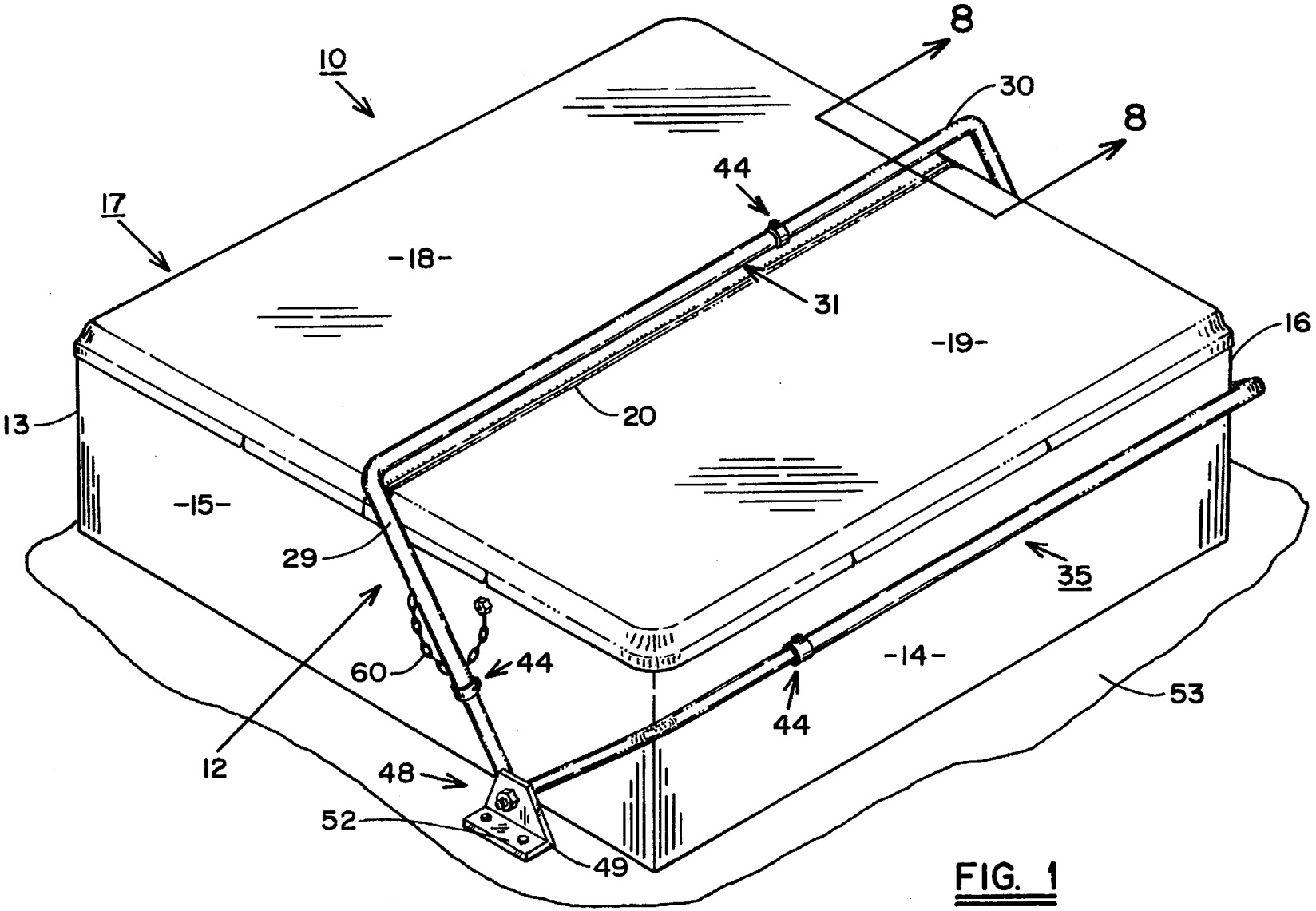
FIG. 1 is a perspective view showing a first embodiment of the present invention which includes a top beam that extends across the full width of the top spa cover.

Referring initially to FIG. 1, there is illustrated an above-ground spa generally referenced 10, that includes a lifting frame 12 embodying the teachings of the present invention. Although the spa can take one of a number of shapes, it is shown rectangular in form and includes a pair of end walls 13 and 14 and a pair of side walls 15 and 16. The top of the spa is closed by a removable cover 17. The cover is made in two half sections 18 and 19 that are joined together by means of a hinge 20 so that the half-sections can be folded one over the other. The cover contains a core section 21 that is enclosed within a high strength sheath 22 that forms part of the hinge between the two half-sections (see FIG. 8). Typically, the core section of the cover is relatively thick to provide sufficient insulation to hold heat within the tub when the cover is closed. As a consequence, the cover is typically relatively bulky and heavy and thus, difficult to remove.

Lifting mechanisms have been devised for use in removing and replacing spa covers. For the most part, these devices have a large number of component parts which tend to weaken the overall structure of the device. Many of these prior art devices are difficult to operate by one person. In addition, these prior art devices, because of their complexity, cannot be readily adjusted for either height or width, and as a consequence, are poorly mated to the spa it services. This, in turn, can adversely effect the operation of the device and produce undue wear on the cover.

As shown in FIG. 1, the present lifting frame is simple in construction, yet fully adjustable in both height and width so that it can be easily mated to a spa for efficient operation during both removal and replacement of the cover. The lifting frame is further provided with an easily accessible foot actuated lever that provides a greatly enhanced mechanical advantage to the user so the cover can be easily removed and replaced by one person. The lifting mechanism is made of high strength light-weight tubing with the various tubular components telescoped one inside the other for adjustability without sacrificing strength. As will be explained below in greater detail, the telescoping joint between the mated tubular components is closed by a high strength split collar arrangement that not only prevents the telescope parts from shifting axially, but also prevents the parts from turning one inside the other.

Figures 3, 4, 5:
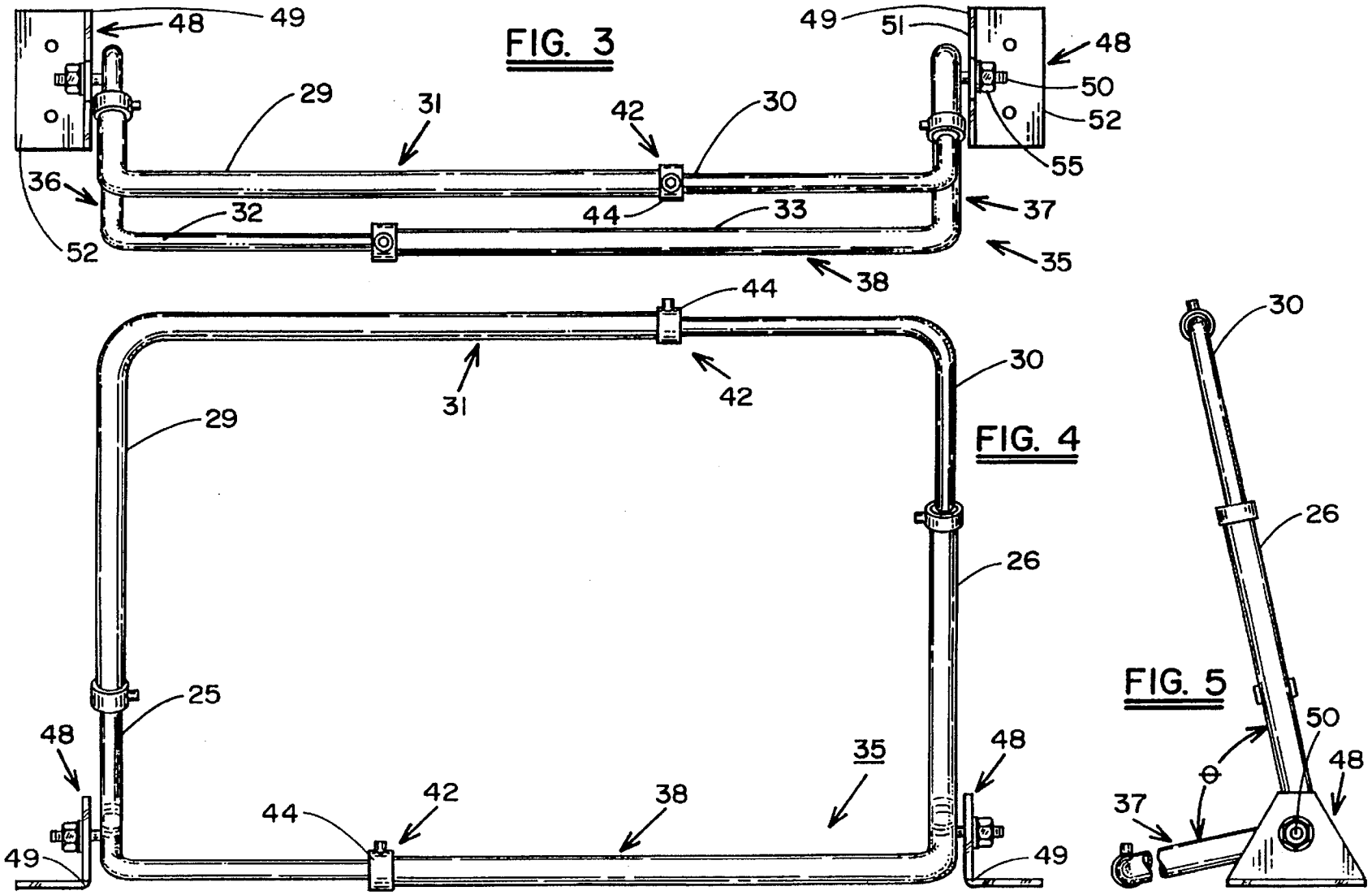
FIG. 3 is a top plan view of the lifting frame shown in FIG. 1.
FIG. 4 is a front elevation of the lifting frame shown in FIG. 3.
FIG. 5 is an end view of the lifting frame shown in FIG. 3.
Figure 7:
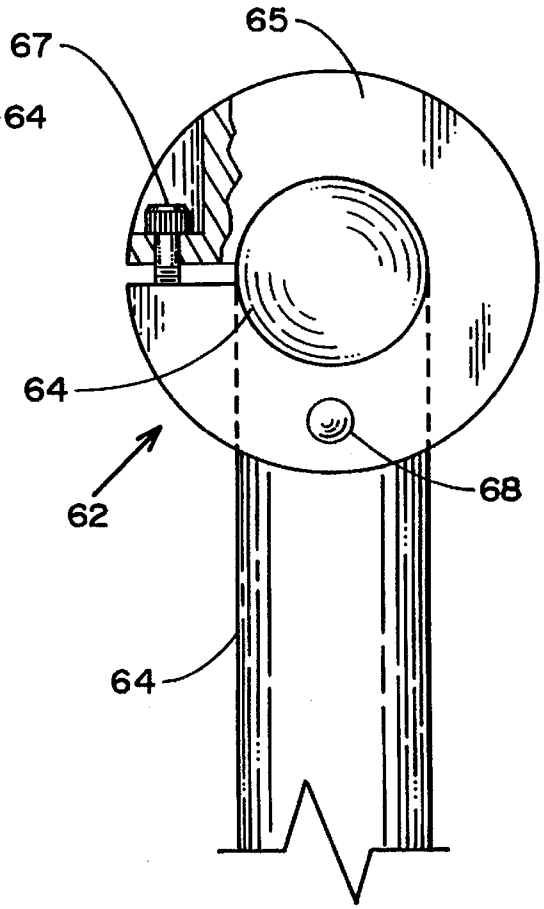
FIG. 7 is an end view of the beam shown in FIG. 6.
Figure 6:
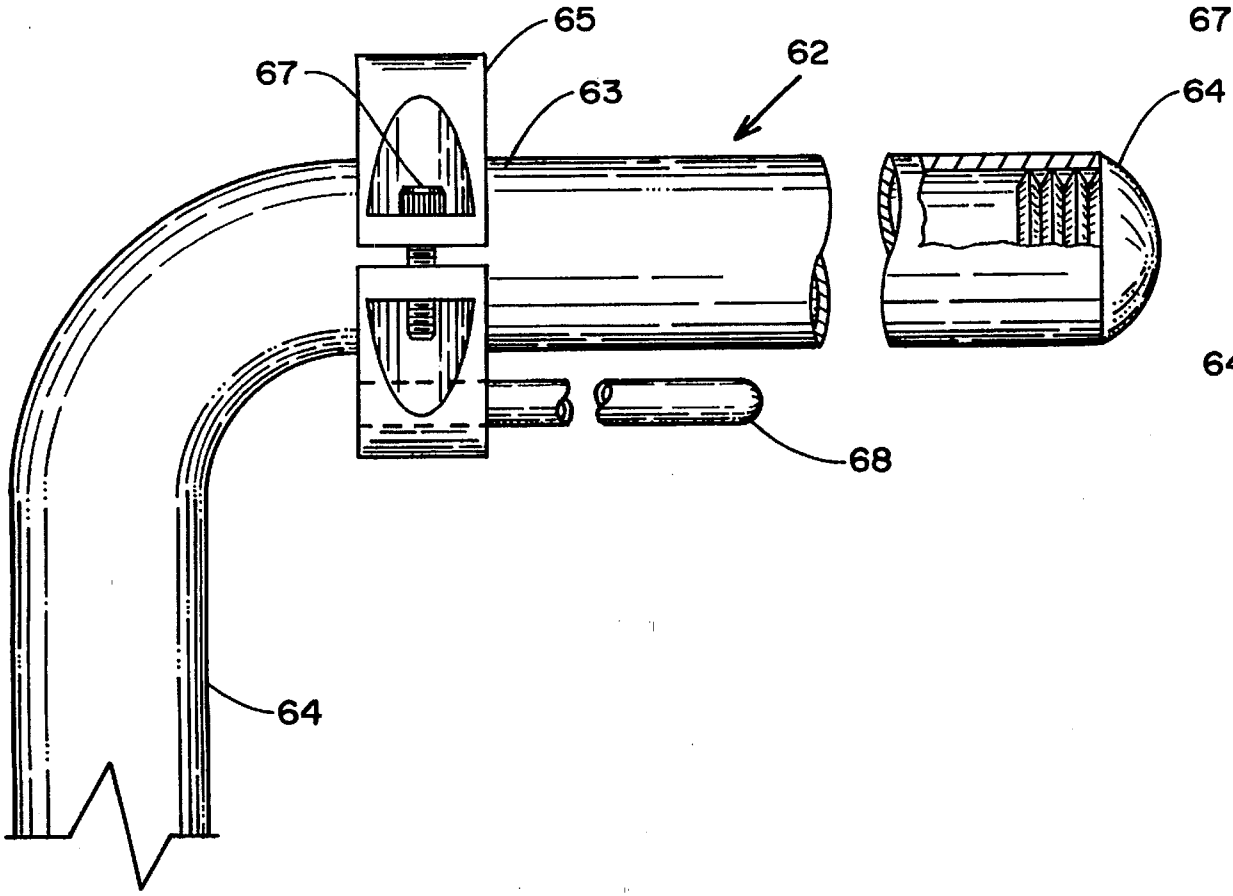
FIG. 6 is an enlarged side elevation of the beam utilized in the lifting frame shown in FIG. 2.

The lifting frame includes a pair of lifting arms 25 and 26 that are joined in telescoping relationship at their upper or distal ends by a pair of L-shaped beam members 29 and 30 to create a cover support member 31. (FIGS. 3–5). The proximal or lower sections 32 and 33 of the two lifting arms are turned inwardly toward each other and telescoped together to form a U-shaped foot bracket generally referenced 35, The U-shaped bracket includes a pair of opposed legs 36 and 37 and a horizontally disposed base member 38. The two legs 36 and 37 of the bracket form an interior angle with the two lifting arms that is less than 90°.

Figure 13:
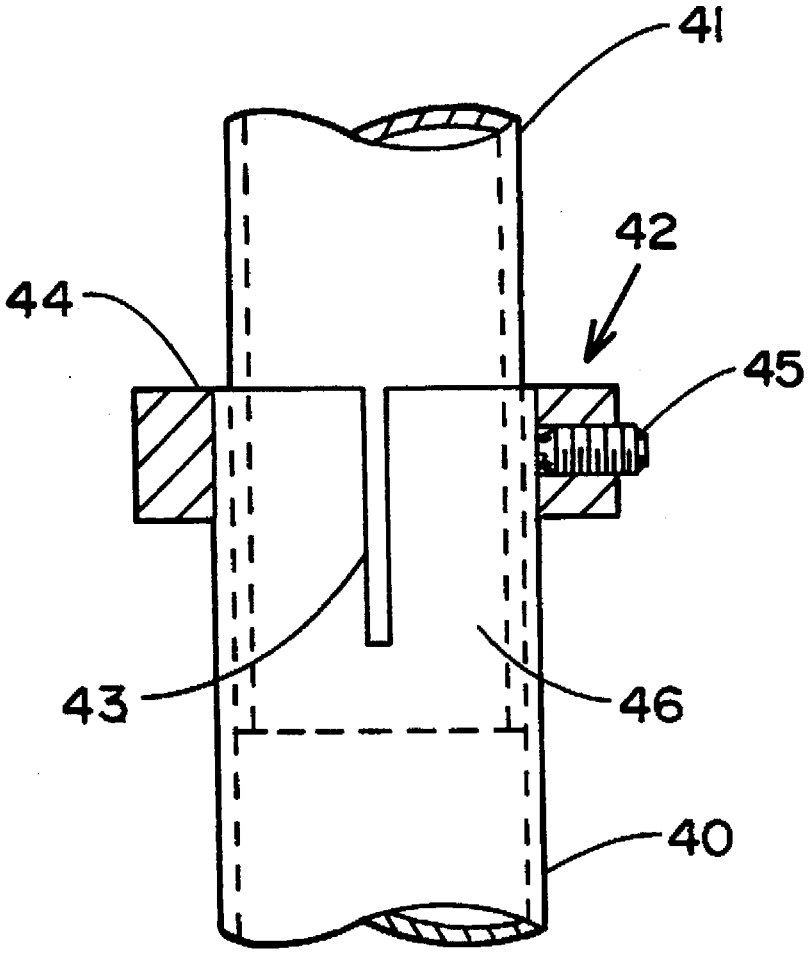
FIG. 13 is an enlarged view in section showing one of the split collar units used in the present invention.

A locking collar assembly is located at each of the telescoping joints. As illustrated at FIG. 13, the assembly includes a female tubular member 40 into which a male tubular member 41 is slidably received and held in place by a retainer 42. In this embodiment, the distal end of the female member is provided with one or more axially aligned slots 43 and an annular locking collar 44 is slipped over the distal end of the female tubular member. One or more set screws 45 are threaded radially through the locking collar and, in assembly, are threaded into locking contact against the distal end tabs 46 of the female tubular member. The female member is deformed inwardly to lock the female member securely against the male member. Sufficient force is applied by the locking collar to prevent the telescoped member from sliding or turning in assembly, thus assuring a high strength joint which resists torque or bending when placed under load.

At each corner where the legs of the bracket 35 join the lifting arms, there is located a pivot unit 48. Each unit includes angle bracket 49 and a pivot pin 50 that is secured to frame at the corner and passes through an opening in the vertical plate 51 of the angle bracket. The horizontal plate 52 of angle bracket may be secured to a deck 53 (FIG. 1 ) that surrounds the tub. Similarly, the end bracket may be replaced by a suitable bracket that is secured to one of the tub side walls by any type of suitable fastener. The pivot pins are mounted within suitable bushings (not shown) within the angle brackets and secured in place by nuts 55.

Figure 8:
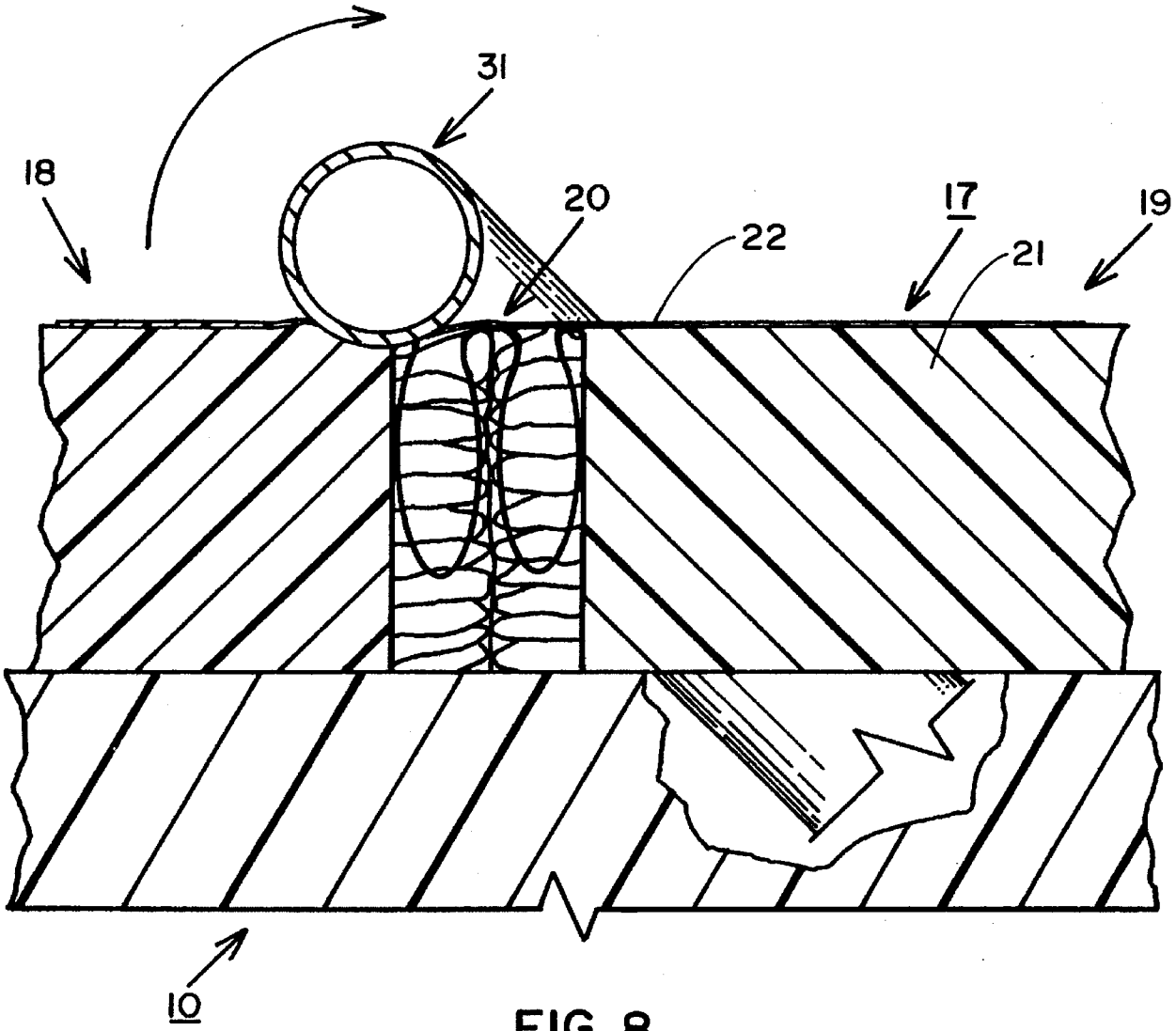
FIG. 8 is a section view taken along lines 8—8 in FIG. 1.

In assembly, the frame is adjusted for the width and height of the tub and the locking collars are then tightened down securely. The beam 31 is placed in parallel alignment with the hinge of the cover 19, as shown in FIG. 8, and the pivot units then secured to the spa deck or alternatively, against the opposing side walls of the spa using any suitable type fasteners. To remove the cover, it is first folded over the lifting frame beam, as shown in FIG. 11. The foot bracket 35, at this time, is at an elevated position, as shown. To raise the cover, the operator simply grasps one of the lifting arms and steps upon the foot bracket 35. The foot bracket acts as a lever which, under the operator's weight, helps to swing the lifting arms and thus the cover upwardly to the raised position adjacent the end wall 14 of the tub as shown in FIG. 12. At this time, the foot bracket rests on the deck. Because the interior angle of the lifting frame corner's formed at the point of joinder between the lifting arms and the foot bracket is less than 90°, the frame, while resting upon the deck is tilted slightly rearwardly, thus allowing the cover to hang down vertically adjacent to the spa end wall 14. A safety chain 60 is attached between the spa and the adjacent lifting arm, which helps to support the frame in the raised position and prevent the frame from over-rotating. The cover is replaced over the tube by simply reversing the above described operation.

Figure 2:
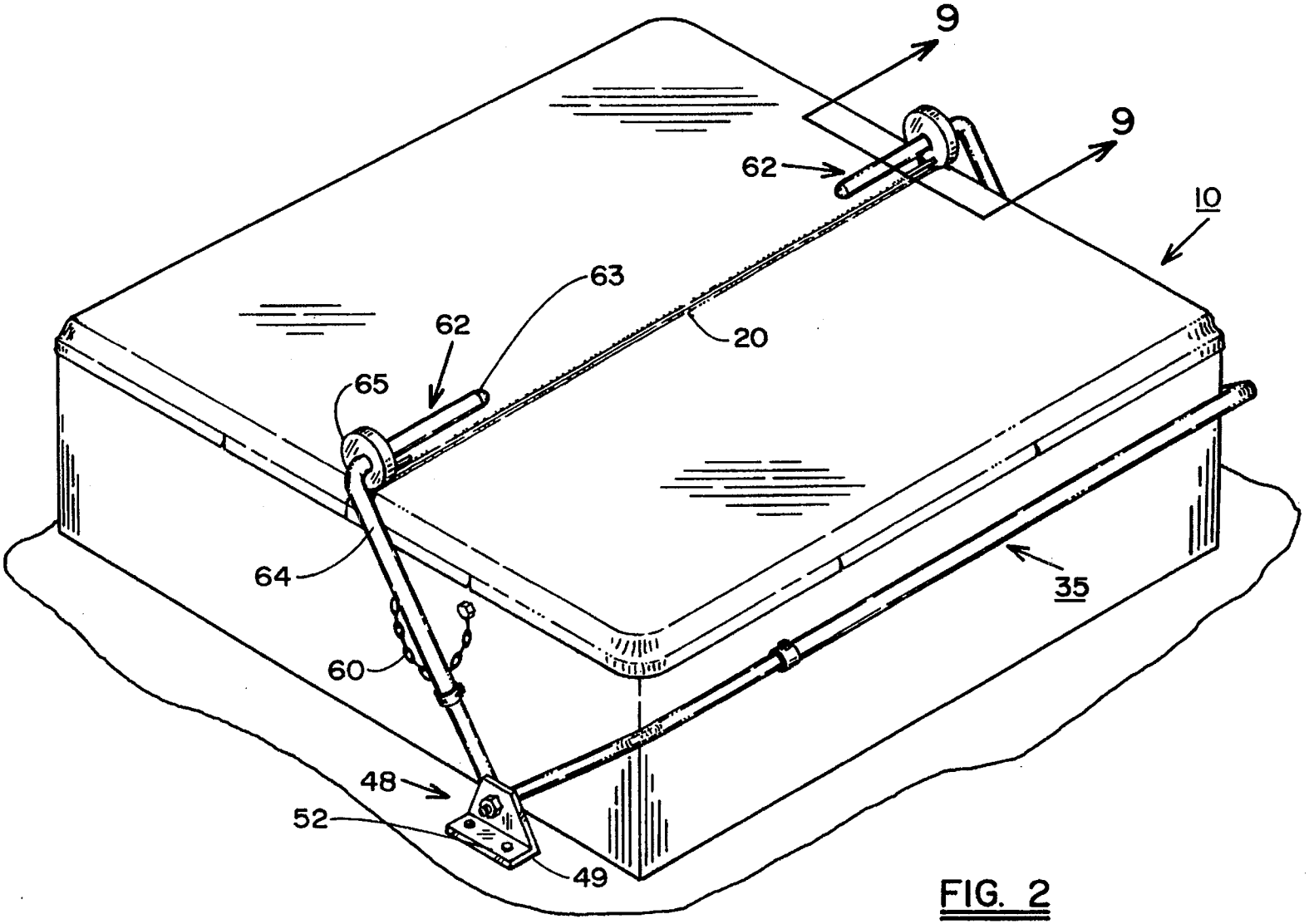
FIG. 2 is a perspective view showing a variant of the embodiment of FIG. 1 which includes a bifurcated top beam having two stub shafts.

Turning now to FIG. 2 where like numbers related to like elements as described above, the lifting frame 12 has been slightly modified so that the beam 31 that extends across the cover along the hinge 20 is replaced by a pair of stub shaft units 62—62 that are positionable adjacent to and parallel with the cover hinge 20 when the lifting frame 12 is placed in the first lowered position. The stub shafts are L-shaped members having a horizontal leg 63 that extends some distance, preferably one or two feet over the cover and a vertical leg 64 that is telescoped into the adjacent lifting arm and adjustably locked in place by means of a retainer 42 of the type described above. The distal end of the leg 63 is closed by an end cap 64. A split collar face plate 65 is mounted upon the horizontal leg of the unit and secured thereto by means of a set screw 67. An alignment pin 68 is stacked in the face plate and is positioned as shown beneath the horizontal leg 63 of the unit.

Figure 9:
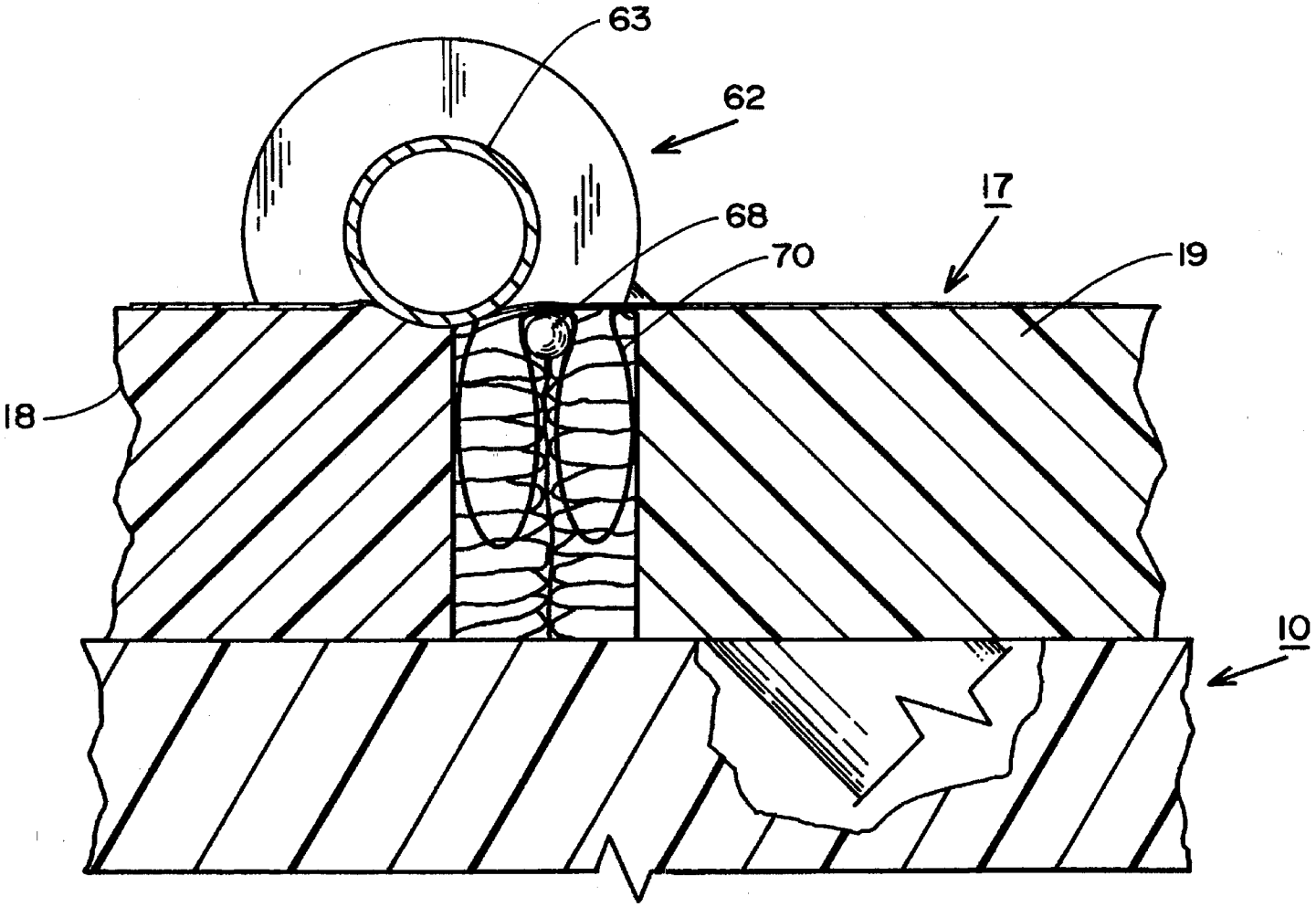
FIG. 9 is a sectional view taken along lines 9—9 in FIG. 2 showing the spa cover in an unfolded condition.
Figure 10:
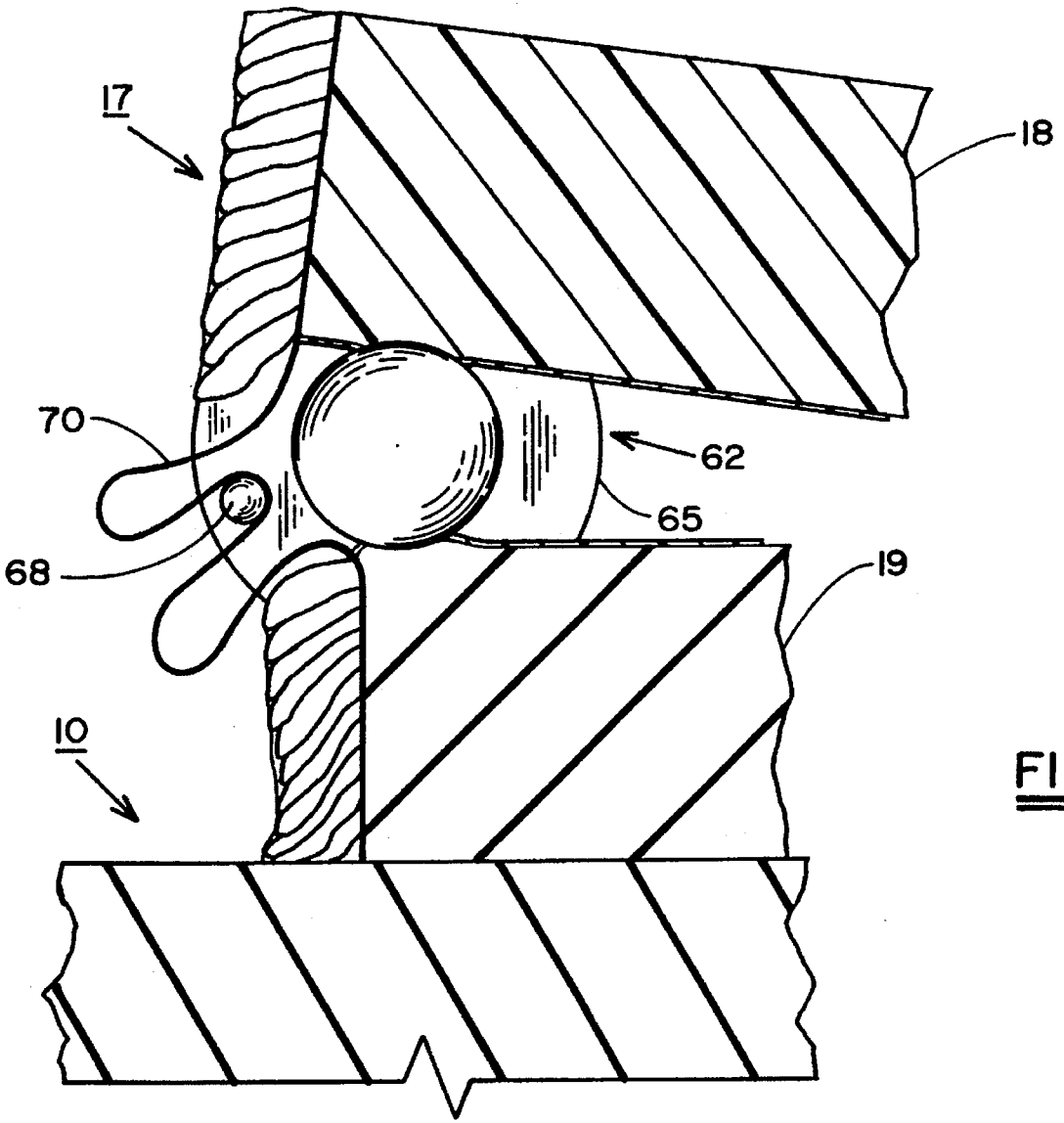
FIG. 10 is a sectional view similar to FIG. 9 showing the spa cover folded over the beam members.

Turning now to FIGS. 9 and 10, the horizontal leg 63 of the stub shaft assembly is arranged to rest on the top of the cover near or at the hinge when the cover is closed over the tub. At this time, the alignment pin 68 is passed into the hinge beneath the pleated section 70 of the hinge as shown in FIG. 9.

To remove the cover from the spa, one-half section 18 is folded over the two stub shaft assemblies as shown in FIGS. 10 and 11 and the frame is moved to the raised position as shown in FIG. 12 to support the cover adjacent to one end wall of the spa. Again, the cover is replaced by reversing the above noted operation.

The aligning pins act to prevent the lifting frame from being moved from the first lowered position into the second raised position when the cover is in an unfolded position. As can be seen, in the event the frame moves from the first position toward the second position with the cover unfolded, the safety dowel will engage the hinge pleat and thus prevent the frame from moving too far out of the first position.

Figure 14:
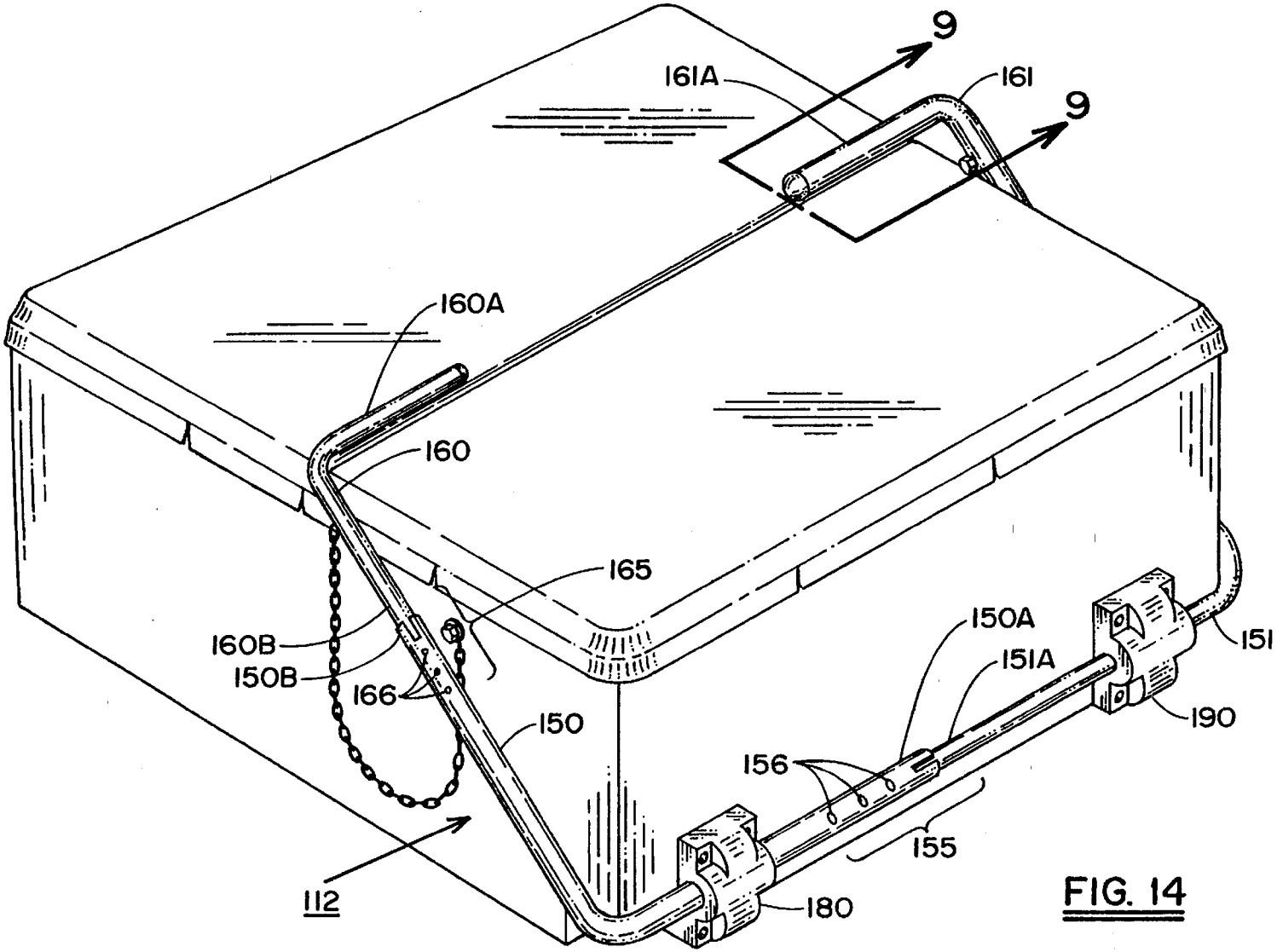
FIG. 14 is a perspective view of a second embodiment of the present invention.

Referring to FIG. 14, there is shown a second, lighter and simpler embodiment of the lifting frame of the invention. This embodiment of the invention differs from that shown in FIGS. 1 and 2 in three principal respects. Firstly, the embodiment of FIG. 14 includes a simpler and lighter generally rectangular frame 112 which does not include a foot actuated lever. Secondly, the embodiment of FIG. 14 has longer lifting arms and a more rearwardly located pivoting axis than the embodiment of FIGS. 1 and 2. Thirdly, the embodiment of FIG. 14 has a different and stronger adjustment mechanism than the embodiment of FIGS. 1 and 2. The nature and significance of these differences will now be discussed with reference to FIGS. 14–20.

In the embodiment of FIG. 14 the lifting frame as a whole is identified by the label 112 and has generally rectangular shape. As is most clearly shown in FIG. 15, this frame includes two monolithic L-shaped lower arms 150 and 151, each having an inner end indicated by the postscript A and an outer end indicated by the postscript B. This frame also includes two monolithic upper arms 160 and 161, each having an inner end indicated by the postscript A and an outer end indicated by the postscript B. Since the inner ends of the upper arms are shorter than the inner ends of the lower arms, the upper arms do not extend into contact with one another. Thus, the inner ends of arms 160, 161 are similar to stub shafts 62 of the embodiment of FIG. 2.

As in the embodiment of FIGS. 1 and 2, the arms of the embodiment of FIG. 14 fit together in telescoping relationship to form joints within which the telescoped arms overlap one another. The inner ends 150A and 151A of lower arms 150 and 151, for example, fit together to form an overlapped joint 155. Similarly, the outer ends 160B and 161B of the upper arms 160 and 161 fit together with outer ends 150B and 151B of arms 150 and 151 to form overlapped joints 165 and 167. These junctions are broadly similar to the corresponding junctions in FIGS. 1 and 2.

Figures 15, 16, 17:
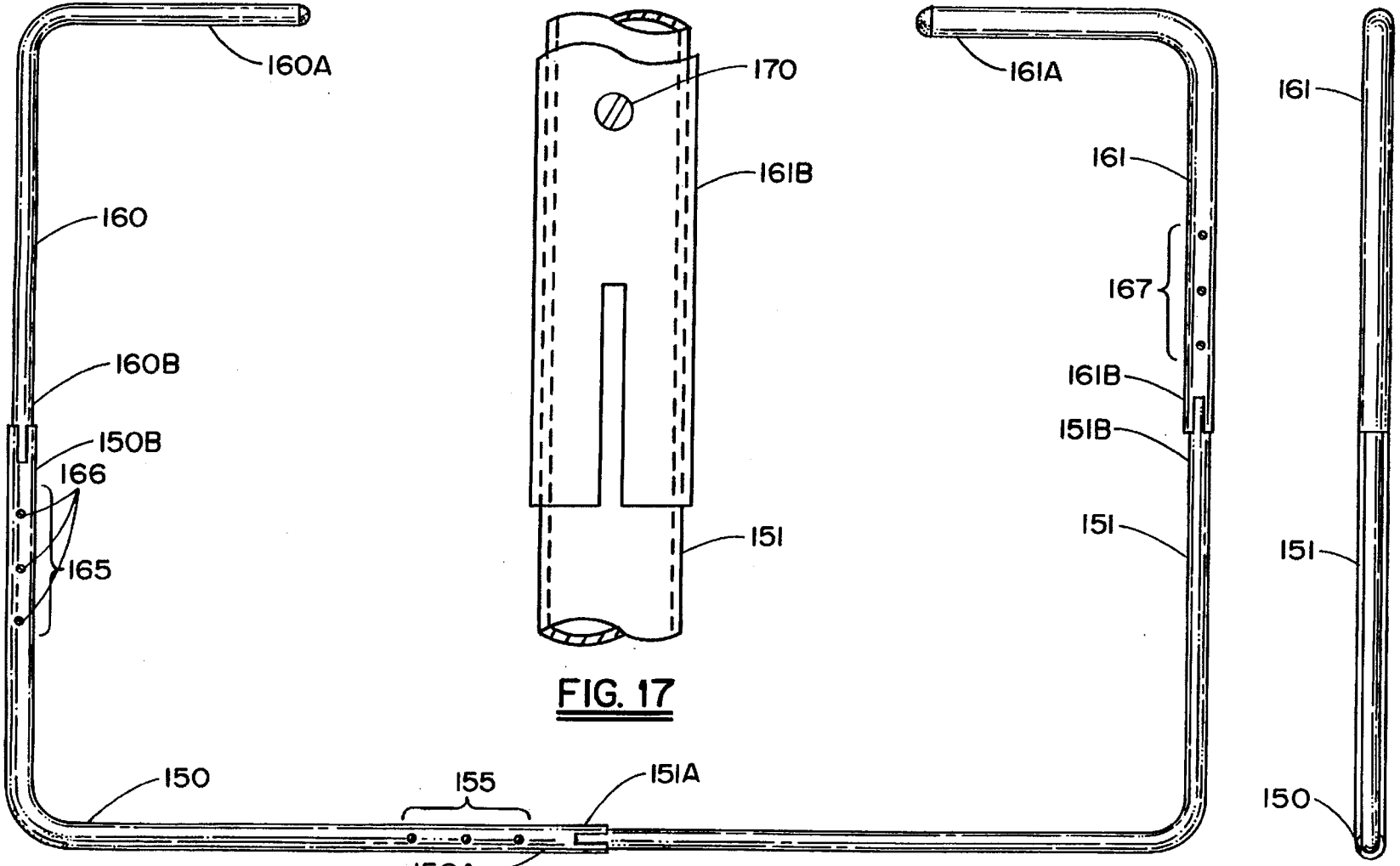
FIG. 15 is a front elevation of the lifting frame shown in FIG. 14.
FIG. 16 is an end view of the lifting frame shown in FIG. 14.
FIG. 17 is an enlarged, fragmentary view of one of the telescoping junctions used in the embodiment of FIG. 14.

Unlike the embodiment of FIGS. 1 and 2, however, the embodiment of FIG. 14 does not use a locking collar with a set screw to fasten the two parts of the joint together. Instead, as is best shown in FIGS. 15 and 16, the portions of each arm that overlap one another within each joint are provided with a plurality of holes which can be slidably aligned with one another in any one of a plurality of selectable positions to adjust the overall length of the lifting arms that include those joints. Holes 156 in the inner end of arm 150, for example, can be aligned with any one of a plurality of similar holes in the inner end of arm 151 to accommodate spas having any of a plurality of different widths. Similarly, holes in the outer ends of arm 160 can be aligned with any of a plurality of similar holes 166 in the outer end of arm 150 to accommodate spas having any of a plurality of different heights or cover lengths. Once the desired combination of hole alignments has been selected, the arms may be locked in their final position by one or more suitable fasteners such as push pins, nuts and bolts, etc. having the strength necessary to bear the loads imposed thereon during the use of the lifting apparatus. FIG. 17 shows an enlarged fragmentary view of a junction having arms that are fastened to one another by a machine screw 170.

While the adjustment and locking mechanisms used by the embodiments of FIGS. 1 and 14 are both usable and practical, the adjustment and locking mechanism of the embodiment of FIG. 14 has advantages that make it specially suited for use with that embodiment. One of these advantages is that it allows the use of fasteners that penetrate both of the fastened arms, and thereby prevent the arms from sliding longitudinally with respect to one another. Another of these is that it allows the carrying of heavier loads. Both of these advantages are of increased significance in embodiments such as that of FIG. 14 in which the lengths of the lifting arms are relatively longer than those of the embodiments of FIGS. 1 and 2.

In accordance with the present invention, the absence of a foot actuated lever in the embodiment of FIG. 14 is compensated for by displacing the pivoting axis of the lifting frame rearwardly with respect to its location in the embodiment of FIGS. 1 and 2. This displacement has the effect of increasing the leverage provided by the lifting frame and thereby decreasing the force necessary to use it. This is because the displacement increases the length of the third class lever formed by arm pairs 150–160 and 151–161.

Figure 18:
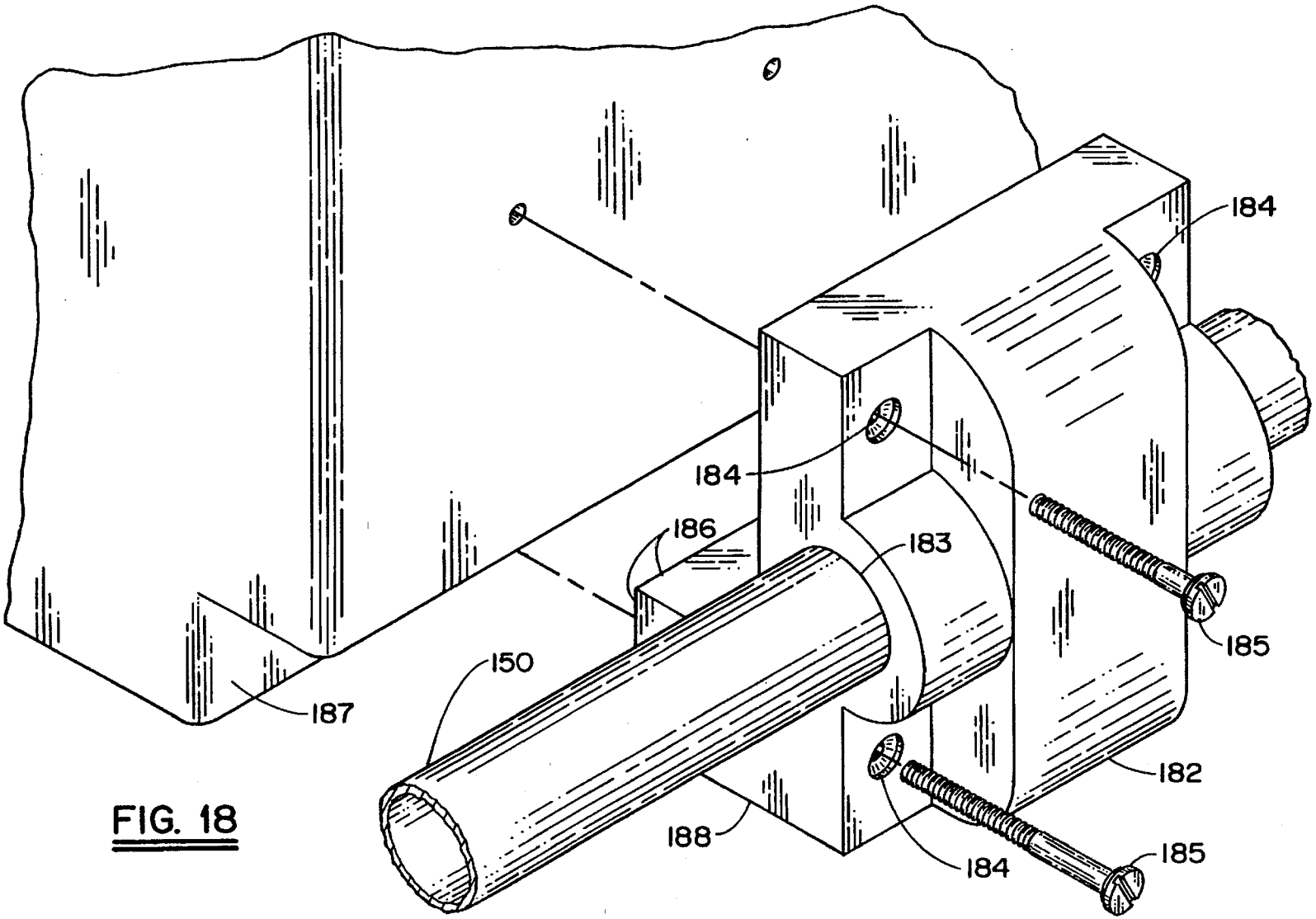
FIG. 18 is a fragmentary, exploded perspective view of one of the pivot units shown in FIG. 14.
Figure 19:
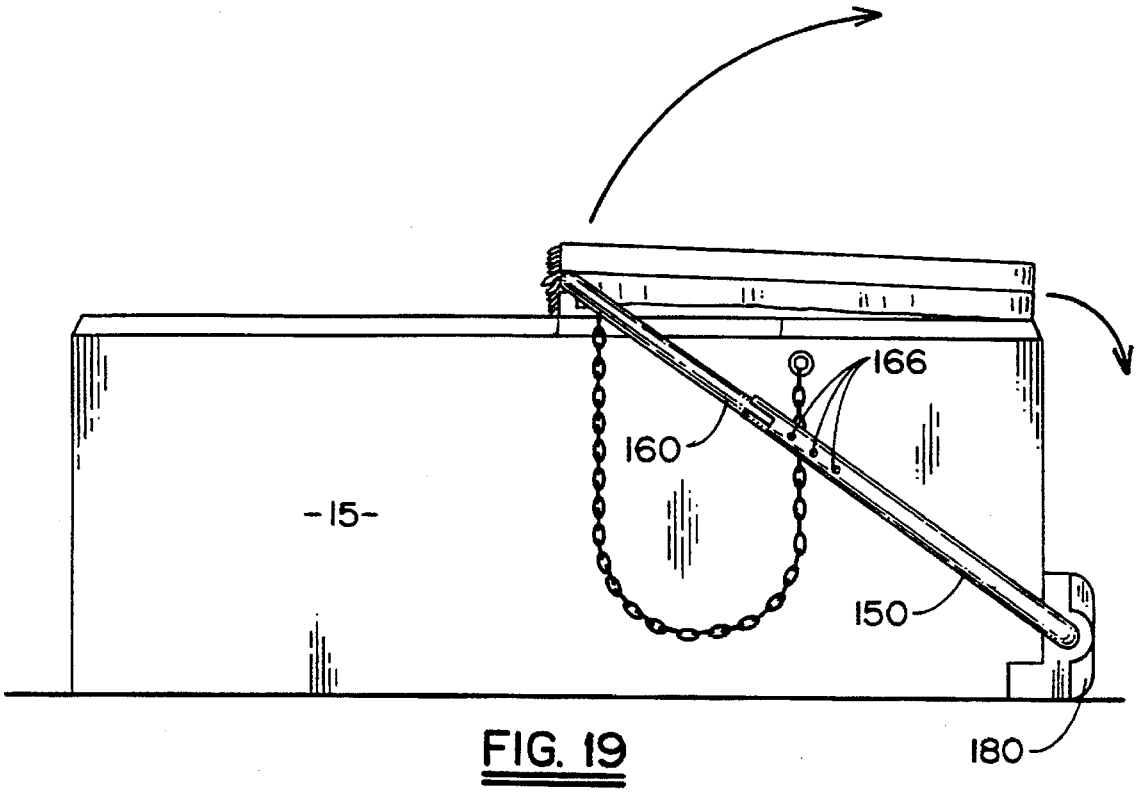
FIGS. 19 and 20 are side views of the lifting frame of FIG. 14 in a first lowered position and in a second raised position, respectively.
Figure 20:
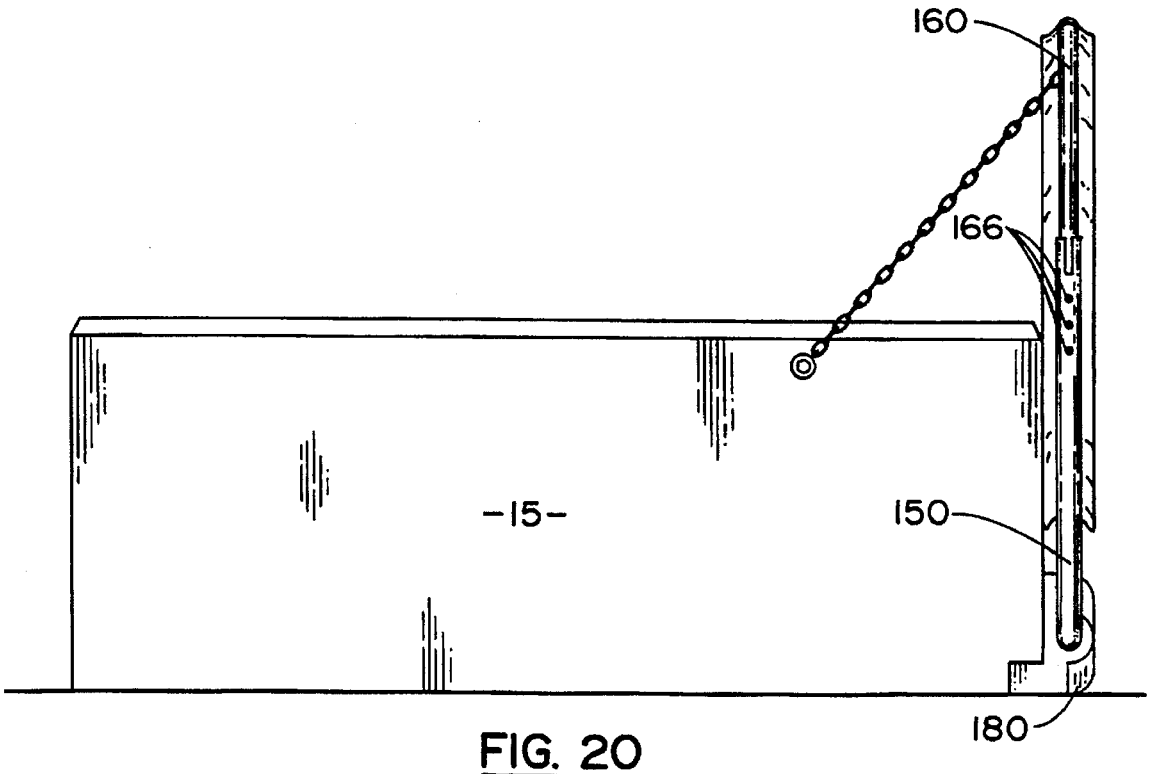

In the preferred embodiment, the above discussed increase in leverage is afforded by including in the lifting frame a pivoting unit which is adapted to be attached to the lower edge of the rear end wall of the spa, as shown in FIGS. 14, 19 and 20. The structure and mode of attachment of one type of pivoting unit which is suitable for use with the present embodiment is shown as pivoting unit 180 in FIG. 18.

As shown in FIG. 18, pivoting unit 180 includes a body 182 which defines a opening 183 for receiving and journalling arm 150, preferably in a suitable bushing (not shown), and a plurality of holes 184 by which body 182 may be fastened to the rear wall of the spa by screws 185. Body 182 also includes a positioning strip 186 that is adapted to fit into a slot 187 at the rear lower edge of the spa and at a lower surface that is adapted to rest on the same surface that supports the spa. It will be understood that arm 151 is journalled in a pivoting unit 190 which is similar to pivoting unit 180 and which is similarly mounted to the rear wall of the spa.

One particularly desirable feature of the use of a pivoting unit having the structure and mounting position shown in FIG. 18 is the support which it provides to the lifting frame by virtue of its resting on the same surface as the spa. This is important because it relieves the wall of the spa, screws 185, etc. of the forces applied to the pivoting unit by the arms of the lifting frame of the invention. Thus, pivoting units 180 and 190 cooperate with the lifting arms to provide a lifting frame which has great structural integrity and yet which provides the leverage necessary to make it easy to use.

While this invention has been explained with reference to the structure disclosed herein, it is not confined to the details set forth and this invention is intended to cover any modifications and changes as may come within the scope of the following claims:

What is claimed is:

1. A spa cover lifting apparatus for a hinged spa cover that has two half sections conjoined by a hinge whereby the half sections are foldable one over the other, and the spa cover is supported by the lifting apparatus so that it may be lifted by rotating the lifting apparatus, said apparatus including:

first and second pivot units;

a first monolithic L-shaped lower arm rotatably mounted in the first pivot unit;

a second monolithic L-shaped lower arm rotatably mounted in the second pivot unit, an inner end of the second lower arm being slidably connected in telescoping relationship with an inner end of the first lower arm to form a first overlapped joint;

a first monolithic L-shaped upper arm, an outer end of the first upper arm being slidably connected in telescoping relationship with an outer end of the first lower arm to form a second overlapped joint;

a second monolithic L-shaped upper arm, an outer end of the second upper arm being slidably connected in telescoping relationship with an outer end of the second lower arm to form a third overlapped joint;

first locking means at the first overlapped joint for adjustably locking the inner ends of the first and second lower arms together at a desired one of a first plurality of discrete positions such that the degree of overlap at the first overlapping joint is adjustable;

second locking means at the second overlapped joint for adjustably locking the outer ends of the first upper and first lower arms together at a desired one of a second plurality of discrete positions such that the degree of overlap at the second overlapping joint is adjustable; and third locking means at the third overlapped joint for adjustably locking the outer ends of the second upper and second lower arms together at a desired one of a third plurality of discrete positions such that the degree of overlap at the third overlapping joint is adjustable, whereby the spa cover lifting apparatus may be adjusted to accommodate spas of differing heights and differing widths.

2. A spa cover lifting apparatus as recited in claim 1, in which the inner arms of said first and second upper arms are spaced apart from one another.

3. For use with a spa and a hinged spa cover that has two half sections conjoined by a hinge, whereby the half sections are foldable one over the other, a method for supporting the spa cover with a lifting apparatus, so that the spa cover may be easily lifted by rotating the lifting apparatus, and whereby the spa cover lifting apparatus may be adjusted to accommodate spas of differing heights and differing widths, said method including:

mounting first and second pivot units to the spa;

rotatably mounting a first monolithic L-shaped lower arm in the first pivot unit;

rotatably mounting a second monolithic L-shaped lower arm in the second pivot unit;

slidably connecting an inner end of the second lower arm is telescoping relationship with an inner end of the first lower arm to form a first overlapped joint;

slidably connecting a first monolithic L-shaped upper arm to the first lower arm, so that an outer end of the first upper arm is in telescoping relationship with an outer end of the first lower arm to form a second overlapped joint;

slidably connecting a second monolithic L-shaped upper arm to the second lower arm, so that an outer end of the second upper arm is slidably connected in telescoping relationship with an outer end of the second lower arm to form a third overlapped joint;

arranging first locking means at the first overlapped joint so that the inner ends of the first and second lower arms can be adjustably locked together at a desired one of a first plurality of discrete positions, such that the degree of overlap at the first overlapping joint is adjustable;

arranging second locking means at the second overlapped joint so that the outer ends of the first upper and first lower arms can be adjustably locked together at a desired one of a second plurality of discrete positions, such that the degree of overlap at the second overlapping joint is adjustable; and arranging third locking means at the third overlapped joint so that the outer ends of the second upper and second lower arms can be adjustably locked together at a desired one of a third plurality of discrete positions, such that the degree of overlap at the third overlapping joint is adjustable.

4. The method for affording easy lifting a hinged spa cover as recited in claim 3, wherein the step of mounting said first and second pivot units to said spa includes the step of mounting said pivot units to a rear wall of said spa.

5. The method for affording easy lifting a hinged spa cover as recited in claim 3, further including the step of arranging said inner arms of said first and second upper arms so that they are spaced apart from one another.

6. The method for affording easy lifting a hinged spa cover as recited in claim 5, wherein the step of mounting said first and second pivot units to said spa includes the step of mounting said pivot units to a rear wall of said spa.

* * * * *